US012644070B2

(12) United States Patent
Verroul et al.

(10) Patent No.: US 12,644,070 B2
(45) Date of Patent: Jun. 2, 2026

(54) AQUEOUS LUBRICANT FOR METALWORKING

(71) Applicant: TOTALENERGIES ONETECH, Courbevoie (FR)

(72) Inventors: Veronique Verroul, Solaize (FR); Richard Frelechoux, Solaize (FR); Mickael Ponsardin, Solaize (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 18/860,585

(22) PCT Filed: Apr. 28, 2023

(86) PCT No.: PCT/EP2023/061222

§ 371 (c)(1),
(2) Date: Oct. 25, 2024

(87) PCT Pub. No.: WO2023/209144

PCT Pub. Date: Nov. 2, 2023

(65) Prior Publication Data

US 2025/0290006 A1 Sep. 18, 2025

(30) Foreign Application Priority Data

Apr. 29, 2022 (FR) ..... 2204066

(51) Int. Cl.

| | |
|---|---|
| ***C10M 173/02*** | (2006.01) |
| ***B21D 37/18*** | (2006.01) |
| ***C10M 173/00*** | (2006.01) |
| ***C10N 40/20*** | (2006.01) |
| ***C10N 40/22*** | (2006.01) |
| ***C10N 40/24*** | (2006.01) |

(52) U.S. Cl.

CPC ..... *C10M 173/02* (2013.01); *B21D 37/18* (2013.01); *C10M 173/00* (2013.01); *C10M 2201/02* (2013.01); *C10M 2201/062* (2013.01); *C10M 2209/107* (2013.01); *C10M 2209/1075* (2013.01); *C10M 2215/042* (2013.01); *C10M 2217/06* (2013.01); *C10N 2040/22* (2013.01); *C10N 2040/24* (2013.01); *C10N 2040/245* (2020.05); *C10N 2040/246* (2020.05)

(58) Field of Classification Search

CPC ... B21D 37/18; C10M 173/00; C10M 173/02; C10M 2201/02; C10M 2201/062; C10M 2209/107; C10M 2209/1075; C10M 2215/042; C10M 2217/06; C10N 2040/22; C10N 2040/24; C10N 2040/245; C10N 2040/246

See application file for complete search history.

(56) References Cited

U.S. PATENT DOCUMENTS

| | | | | |
|---|---|---|---|---|
| 4,043,925 | A * | 8/1977 | Felton, Jr. | C10M 173/02 508/173 |
| 4,552,686 | A * | 11/1985 | Morris-Sherwood | C21D 1/60 252/396 |
| 6,855,676 | B2 * | 2/2005 | Li | C10M 173/025 508/250 |
| 2018/0291301 | A1 * | 10/2018 | Kirsch | C10M 129/48 |

FOREIGN PATENT DOCUMENTS

| | | | | |
|---|---|---|---|---|
| JP | H08239683 | A * | 9/1996 | C10M 107/34 |

OTHER PUBLICATIONS

English-language machine translation of JP 8-239683 A (Year: 1996).*

* cited by examiner

*Primary Examiner* — James C Goloboy
(74) *Attorney, Agent, or Firm* — DUANE MORRIS LLP; Gregory M. Lefkowitz

(57) ABSTRACT

The invention relates to a lubricant composition comprising water and:

from 1 to 60% by weight of poly(alkylene glycol), from 0.5 to 30% by weight of polyetheramine, relative to the total weight of the lubricating composition.

The invention further relates to the use of said lubricating composition as a fluid for working metals, the metals being preferably chosen from steel and aluminum.

18 Claims, No Drawings

AQUEOUS LUBRICANT FOR METALWORKING

TECHNICAL FIELD OF THE INVENTION

The invention relates to an aqueous lubricant intended to be used in metalworking, more particularly for machining (turning, milling, drilling, sawing, threading, etc.), forming, cutting, stamping or else rolling of metal parts, in particular of aluminum or steel.

PRIOR ART

Lubricants are traditionally used for metalworking. There are aqueous lubricants and non-aqueous lubricants, also called organic lubricants.

The aqueous-based formulations currently on the market are generally in emulsion form and generally do not meet all expectations for machining metal parts, in particular of aluminum, from a point of view of the quality of parts, performance (speed, feed), tool service life. Testing performed with products intended primarily for steel may have limitations on aluminum, a softer material requiring the addition of specific additives.

There are aqueous fluids comprising poly(alkylene glycol). In general, same do not meet all the expectations of manufacturers for use in both steel and aluminum.

Documents CN108977264, CN108998187, WO2021/250210 and U.S. Pat. No. 5,744,432 disclose aqueous fluids for metalworking. The above documents do not disclose the aqueous lubricating composition according to the invention.

The present invention proposes a lubricating composition having improved lubricating properties for machining metal parts, in particular aluminum and steel, and also for forming, cutting, stamping or rolling metal parts.

SUMMARY OF THE INVENTION

The invention relates to a lubricant composition comprising water and:

- from 1 to 60% by weight of poly(alkylene glycol), said poly(alkylene glycol) being chosen from block copolymers comprising ethylene oxide units and propylene oxide units,
- from 0.5 to 30% by weight of polyetheramine, relative to the total weight of the lubricating composition.

According to one embodiment, the lubricating composition according to the invention comprises water and:

- from 5 to 50% by weight of poly(alkylene glycol) comprising alkylene oxide units containing from 2 to 16 carbon atoms, preferably from 2 to 8 carbon atoms, said poly(alkylene glycol) being chosen from block copolymers comprising ethylene oxide units and propylene oxide units,
- from 1 to 20% by weight of polyetheramine chosen from monoamines, diamines and triamines including units chosen from alkylene oxides containing 2 to 8 carbon atoms, preferably 2 to 4 carbon atoms, relative to the total weight of the lubricating composition.

According to one embodiment, the lubricating composition according to the invention further comprises at least one additive chosen from alkaline bases, alkanolamines and mixtures thereof,

- the alkanolamines are preferably chosen from monoethanolamine, diethanolamine, triethanolamine, diglycolamine, monoisopropanolamine, diisopropanolamine, triisopropanolamine, methyldiethanolamine, 2-amino-2-ethyl-1,3-propanediol, 2-amino-2-methyl-1-propanol and mixtures thereof, and
- the alkaline bases are preferably chosen from potassium hydroxide and sodium hydroxide.

Preferably, the poly(alkylene glycol) or poly(alkylene glycol) are chosen from block copolymers comprising ethylene oxide units and propylene oxide units, and mixtures thereof, preferably from block copolymers comprising ethylene oxide units and propylene oxide units and mixtures thereof, more preferably from ethylene oxide-propylene oxide diblock copolymers and propylene-ethylene oxide-propylene oxide or ethylene oxide-propylene oxide-ethylene oxide triblock copolymers, and mixtures thereof.

According to one embodiment, each poly(alkylene glycol) has a molecular weight ranging from 500 to 10,000 g/mol, preferably from 800 to 5,000 g/mol, more preferably from 1,100 to 3,000 g/mol.

According to one embodiment, each poly(alkylene glycol) has a viscosity at 40° C. ranging from 10 to 1,000 $mm^2/s$, preferably from 15 to 500 $mm^2/s$, more preferably from 20 to 400 $mm^2/s$.

According to one embodiment, the polyetheramine(s) are chosen from monoamines comprising ethylene oxide units and/or propylene oxide units, diamines comprising ethylene oxide units and/or propylene oxide units, and mixtures thereof, preferably from diamines comprising ethylene oxide units and/or propylene oxide units.

According to one embodiment, each polyetheramine has a molecular weight ranging from 500 to 5,000 g/mol, preferably from 1,000 to 3,000 g/mol.

The invention further relates to the use of the lubricating composition according to the invention as a fluid for metalworking, the metals preferably being chosen from steel and aluminum.

Preferably, the composition is used for metal machining and/or for forming and/or for cutting and/or for stamping and/or for rolling metals.

The invention further relates to the use of 0.5 to 30% by weight of polyetheramines in a lubricating composition comprising water and 1 to 60% by weight of poly(alkylene glycol), relative to the total weight of the lubricating composition, to improve the lubricating properties during the metalworking by means of said lubricating composition.

Preferably, the lubricating composition is as defined in the present invention.

According to one embodiment, the 0.5 to 30% by weight of polyetheramines are used to improve the lubricating properties of the lubricating composition during machining and/or during forming and/or during cutting, and/or during stamping and/or during rolling metals.

The invention makes it possible to provide a multi-service lubricating composition since same can be applied equally well to aluminum surfaces or steel surfaces.

The invention makes it possible to provide a lubricating composition having a good toxicological profile and a low impact on the environment.

The invention makes it possible to provide a lubricating composition that does not generate an oil deposit on the ground, which increases the safety of the operators.

The lubricating composition according to the invention has improved lubricating properties, not only on aluminum but also on steel.

DETAILED DESCRIPTION OF THE INVENTION

The invention relates to a lubricant composition comprising water and:

from 1 to 60% by weight, preferably from 5 to 50% by weight, more preferably from 10 to 40% by weight, of polyalkylene glycol, said poly(alkylene glycol) being chosen from block copolymers comprising ethylene oxide units and propylene oxide units, from 0.5 to 30% by weight, preferably from 1 to 20% by weight, more preferably from 2 to 15% by weight, of polyetheramine, relative to the total weight of the lubricating composition, wherein said lubricating composition can be in the form of a solution or in the form of an emulsion, preferably in the form of a solution.

Polyalkylene Glycol (PAG)

According to the invention, the PAG(s) of the lubricating composition according to the invention are chosen from PAG(s) comprising ethylene oxide units and propylene oxide units.

According to one embodiment, the PAG(s) used in the lubricating composition according to the invention corresponds to formula (I):

$$R—(OA)_zOH \quad (I)$$

wherein:

R represents a hydrogen atom or a linear or branched alkyl group comprising from 1 to 5 carbon atoms;

A, either all identical or different, represents a linear or branched alkyl group, comprising from 2 to 16 carbon atoms, preferably from 2 to 8 carbon atoms, more preferably from 2 to 4 carbon atoms, even 2 to 3 carbon atoms;

z represents an integer greater than or equal to 2, preferably an integer greater than or equal to 4, it being understood that at least one radical A is an ethylene group and at least one radical A is a propylene group.

According to one embodiment, the PAG(s) of the lubricating composition according to the invention are chosen from block copolymers comprising ethylene oxide units and propylene oxide units, and mixtures thereof, preferably from block copolymers comprising ethylene oxide units and propylene oxide units and mixtures thereof, more preferably from ethylene oxide-propylene oxide diblock copolymers and propylene oxide-ethylene oxide-propylene oxide triblock copolymers and mixtures thereof.

More particularly, when the PAG is chosen from block copolymers comprising ethylene oxide units and propylene oxide units, the lubricating composition exhibits better performances for metalworking.

"Block copolymers comprising ethylene oxide units and propylene oxide units", as defined by the present invention, refers to copolymers comprising at least one block derived from the polymerization of ethylene glycol and at least one block derived from the polymerization of propylene glycol. Same can then be called PEG/PPG.

"Ethylene oxide-propylene oxide diblock copolymers", as defined by the present invention, refers to copolymers consisting of two blocks, one block derived from the polymerization of ethylene glycol and one block derived from the polymerization of propylene glycol. Same can then be called PEG-PPG.

"Propylene oxide-ethylene oxide-propylene oxide triblock copolymers" as defined by the present invention, refers to copolymers consisting of three block sequences, one block derived from the polymerization of propylene glycol, one block derived from the polymerization of ethylene glycol and one block derived from the polymerization of propylene glycol (in the present order). Same can then be called PPG-PEG-PPG.

The PAG(s) used in the invention may comprise, if appropriate, alkyl end groups, e.g. chosen from linear or branched alkyls containing from 1 to 5 carbon atoms. Preferably, the PAG(s) used in the invention do not comprise such alkyl end groups.

According to one embodiment, the lubricating composition comprises at least one PAG comprising —$OCH_2CH_2$— units and —$OCH_2CH(CH_3)$— units such that the weight ratio between the $OCH_2CH_2$ units and the $OCH_2CH(CH_3)$ units ranges from 0.1 to 0.9, preferably from 0.2 to 0.7, more preferably from 0.25 to 0.5.

According to one embodiment, the PAG(s) used in the lubricating composition according to the invention corresponds to one of the formulae (II) to (V):

$$R—(OCH_2CH_2)_x(OCH_2CH(CH_3))_yOH \quad (II);$$

$$R—(OCH_2CH(CH_3))_y(OCH_2CH_2)_xOH \quad (III);$$

$$R—(OCH_2CH(CH_3))_y(OCH_2CH_2)_x(OCH_2CH(CH_3))_{y'}OH \quad (IV);$$

$$R—(OCH_2CH_2)_x(OCH_2CH(CH_3))_y(OCH_2CH_2)_{x'}OH \quad (V);$$

wherein:

R represents a hydrogen atom or a linear or branched saturated alkyl group comprising from 1 to 5 carbon atoms;

x and x', either identical or different, represents an integer greater than or equal to 2, preferably greater than or equal to 4, y and y', either identical or different, represents an integer greater than or equal to 2.

Preferably, in the compounds of formula (II), (III), (IV) or (V) according to the invention, x, x', y and y' are, independently of one another, an integer ranging from 2 to 30, preferably from 4 to 25, advantageously from 6 to 20.

Preferably, in formula (IV), x is an integer ranging from 2 to 30, preferably from 4 to 25, advantageously from 6 to 20, and the sum y+y' ranges from 8 to 45, preferably from 12 to 40, more preferably from 20 to 35.

Preferably, in formula (V), y is an integer ranging from 2 to 30, preferably from 4 to 25, advantageously from 6 to 20, and the sum x+x' ranges from 8 to 45, preferably from 12 to 40, more preferably from 20 to 35.

Preferably, in the compounds of formula (II), (III), (IV) or (V) of the PAG entering the lubricating composition according to the invention, R is a hydrogen atom.

According to one embodiment, each PAG entering the lubricating composition according to the invention corresponds to formula (IV) wherein R is a hydrogen atom, where x, y and y' are each independently of one another chosen from integers ranging from 6 to 20 and the sum y+y' ranges from 20 to 35.

According to one embodiment, each PAG entering the lubricating composition according to the invention has a molecular weight ranging from 500 to 10,000 g/mol, preferably from 800 to 5,000 g/mol, more preferably from 1,100 to 3,000 g/mol.

According to one embodiment, each PAG entering the lubricating composition according to the invention has a viscosity at 40° C. ranging from 10 to 1000 $mm^2/s$, preferably from 15 to 500 $mm^2/s$, more preferably from 20 to 400 $mm^2/s$.

The viscosity at 40° C. can be measured according to the standard ASTM D7042.

According to one embodiment, each PAG entering the lubricating composition according to the invention has a pour point of less than 0° C., preferably less than −15° C., more preferably less than −20° C.

The pour point can be measured according to the standard ISO 3016.

The PAG or PAGs represent from 1 to 60% by weight, preferably from 5 to 50% by weight, more preferably from 10 to 40% by weight, of the total weight of the lubricating composition (100% by weight).

PAGs are commercially available products.

Polyetheramine (PEA)

According to one embodiment, the PEA(s) used in the lubricating composition according to the invention are chosen from monoamines, diamines and triamines comprising one or a plurality of units chosen from alkylene oxides comprising from 2 to 8 carbon atoms, preferably from 2 to 4 carbon atoms.

In the context of the present invention, the PEA(s) entering the lubricating composition are different from the PAGs entering the lubricating composition.

According to one embodiment, the PEA(s) used in the lubricating composition according to the invention are chosen from monoamines comprising ethylene oxide units and/or propylene oxide units, diamines comprising ethylene oxide units and/or propylene oxide units, and mixtures thereof, preferably from diamines comprising ethylene oxide units and/or propylene oxide units.

"Monoamine comprising ethylene oxide units and/or propylene oxide units", as defined by the present invention refers to a compound including a single amine functional group and comprising (i) a block derived from the polymerization of ethylene glycol and/or (ii) a block derived from the polymerization of propylene glycol.

"Diamine comprising ethylene oxide units and/or propylene oxide units" refers to a compound including exactly two amine functional groups and including (i) a block derived from the polymerization of ethylene glycol and/or (ii) a block derived from the polymerization of propylene glycol.

Preferably, the PEA(s) entering the lubricating composition according to the invention are chosen from primary amines.

According to a particular embodiment, the PEA(s) used in the lubricating composition according to the invention are chosen from diamines comprising ethylene oxide units and propylene oxide units.

"Diamine comprising ethylene oxide units and/or propylene oxide units", as defined by the present invention, refers to a compound including exactly two amine functions and comprising (i) a block derived from the polymerization of ethylene glycol and (ii) a block derived from the polymerization of propylene glycol.

According to one embodiment, the PEA or PEAs used in the lubricating composition according to the invention correspond to formula (VI), (VIa), (VII), (VIIa), (VIII), (VIIIa), (IX) and/or (X):

$$H_3C—(OCH_2CH_2)_r(OCH_2CH(CH_3))_s—NH_2 \quad (VI)$$

$$H_3C—(OCH_2CH(CH_3))_s—(OCH_2CH_2)_r—NH_2 \quad (VIa)$$

$$H_2N—CH(CH_3)—CH_2—(OCH_2CH(CH_3))_t—NH_2 \quad (VII)$$

$$H_2N—CH(CH_3)—CH_2—(OCH_2CH_2)_r—NH_2 \quad (VIIa)$$

$$H_2N—CH(CH_3)—CH_2—(OCH_2CH(CH_3))_u(OCH_2CH_2)_v(OCH_2CH(CH_3))_w—NH_2 \quad (VIII)$$

$$H_2N—CH(CH_3)—CH_2—(OCH_2CH_2)_u(OCH_2CH(CH_3))_v(OCH_2CH_2)_w—NH_2 \quad (VIIIa)$$

$$H_3C—(OCH_2CH_2)_r—NH_2 \quad (IX)$$

$$H_3C—(OCH_2CH(CH_3))_t—NH_2 \quad (X)$$

wherein:

R represents an integer greater than or equal to 2, preferably greater than or equal to 5, more preferably greater than or equal to 8;

s represents an integer greater than or equal to 2, preferably greater than or equal to 5, more preferably greater than or equal to 8;

t represents an integer greater than or equal to 6, preferably greater than or equal to 10, more preferably greater than or equal to 15;

u represents an integer greater than or equal to 2, preferably greater than or equal to 5, more preferably greater than or equal to 8;

v represents an integer greater than or equal to 2, preferably greater than or equal to 5, more preferably greater than or equal to 8;

w represents an integer greater than or equal to 2, preferably greater than or equal to 5, more preferably greater than or equal to 8;

provided that:

r+s is greater than or equal to 6, preferably greater than or equal to 10, more preferably greater than or equal to 15 in the formula (VI) and (VIa) and that:

u+v+w is greater than or equal to 6, preferably greater than or equal to 10, more preferably greater than or equal to 15 in the formula (VIII) and (VIIIa).

The PEA used in the lubricating composition according to the invention may comprise a mixture of PEA, in particular a mixture of PEA of formula (VI), (VIa), (VII), (VIIa), (VIII), (VIIIa), (IX) and/or (X).

According to one embodiment, the lubricating composition according to the invention comprises at least one PEA corresponding to one of formulae (VI), (VII) or (VIII).

According to one embodiment, the PEA(s) entering the lubricating composition according to the invention comprise at least 50% by weight of PEA corresponding to formula (VI), (VII) and/or (VIII), relative to the total weight of the PEAs.

According to one embodiment, the PEA(s) entering the lubricating composition according to the invention comprise, relative to the total weight of the PEAs, at least 50% by weight, preferably at least 70% by weight, preferably at least 90% by weight, of PEA corresponding to formula (VII), preferably wherein t is an integer ranging from 6 to 70, preferably from 10 to 60, more preferably from 15 to 50.

According to one embodiment, the PEA(s) entering the lubricating composition according to the invention comprise, relative to the total weight of the PEAs, at least 50% by weight, preferably at least 70% by weight, preferably at least 90% by weight, of PEA corresponding to formula (VI), preferably wherein r and s are such that the molecular weight ranges from 1,000 to 3,000 g/mol.

According to one embodiment, the PEA(s) entering the lubricating composition according to the invention corresponds to formula (VII), preferably wherein t is an integer ranging from 6 to 70, preferably from 10 to 60, more preferably from 15 to 50.

According to one embodiment, the PEA(s) entering the lubricating composition according to the invention corresponds to formula (VI), preferably wherein r and s are such that the molecular weight ranges from 1,000 to 3,000 g/mol.

According to one embodiment, the PEA(s) entering the lubricating composition according to the invention has a molecular weight ranging from 500 to 5,000 g/mol, preferably from 1,000 to 3,000 g/mol.

The PEA or PAGs represent from 0.5 to 30% by weight, preferably from 1 to 20% by weight, more preferably from 2 to 15% by weight, of the total weight of the lubricating composition (100% by weight)

PEAs are commercially available products.

Lubricating Composition

The lubricating composition according to the invention is an aqueous lubricating composition. The water may represent from 10 to 90% by weight of the total weight of the lubricating composition or from 20 to 60% by weight of the total weight of the lubricating composition.

The lubricating composition may be in the form of a solution or of an emulsion.

If the composition is in the form of an emulsion, same would typically be an oil-in-water emulsion when used for metalworking, wherein the oil may be chosen from mineral oils, vegetable oils and animal oils.

Depending on the embodiment where the lubricating composition is in the form of an emulsion, the oil portion of the emulsion will typically represent from 1 to 60% by weight, preferably from 5 to 40% by weight, of the weight of the lubricating composition.

According to a preferred embodiment, the lubricating composition according to the invention is in the form of a solution. Indeed, the ingredients of the lubricating composition are preferably chosen such that same are soluble or solubilized in water.

"Solution", as defined by the present invention, contains only one phase and is distinguished from an emulsion that may contain a plurality of phases and is distinguished from a dispersion that may contain non-solubilized particles.

Thereby, according to a preferred embodiment, the aqueous lubricating composition according to the invention is not in the form of an emulsion.

The lubricating composition according to the invention may further comprise at least one additive chosen from additives conventionally used by a person skilled in the art in lubricating compositions for metalworking, preferably at least one additive chosen from pH regulators, anticorrosion agents, antifoams, biocides, wetting agents, friction modifiers, antifreeze additives, preferably antifoams and biocides, alone or as a mixture.

According to one embodiment, the lubricating composition according to the invention further comprises at least one pH regulator additive, more particularly an alkaline buffer. The pH regulator serves to maintain the desired pH of the lubricating composition, more particularly in order to preserve an alkaline pH, advantageously comprised between 8 and 11, so as in particular to prevent a corrosion of the metal surfaces.

The pH regulator may be chosen from the family of amines, more particularly alkanolamines and amino alcohols, or else from the family of alkaline bases.

It may be in particular a pH regulator additive chosen from ethanolamines, such as monoethanolamine (MEA), diethanolamine (DEA); triethanolamine (TEA), diglycolamine (DGA), isopropanolamines, such as monoisopropanolamine (MIPA), diisopropanolamine (DIPA) and triisopropanolamine (TIPA), ethylene amines, ethylenediamine (EDA), diethylenetriamine (DETA, triethylenetetramine (TETA) and tetraethylene pentamine (TEPA), alkanolamines, such as methyldiethanol amine (MDEA), cyclamines, such as cyclohexylamine, 2-amino-2-ethyl-1,3-propanediol, 2-amino-2-methyl-1-propanol and mixtures thereof.

According to one embodiment, the lubricating composition further comprises at least one additive chosen from alkaline bases, alkanolamines and mixtures thereof,

- the alkanolamines being preferably chosen from monoethanolamine, diethanolamine, triethanolamine, diglycolamine, monoisopropanolamine, diisopropanolamine, triisopropanolamine, methyldiethanol amine, 2-amino-2-ethyl-1,3-propanediol, 2-amino-2-methyl-1-propanol and mixtures thereof, and
- the alkaline bases are preferably chosen from potassium hydroxide and sodium hydroxide.

According to one embodiment, the lubricating composition comprises from 1 to 50% by weight of a pH regulator additive, preferably from 10 to 40% by weight, relative to the total weight of the lubricating composition, said pH regulator additive being preferably chosen from amines, preferably from alkanolamines, such as monoethanolamine (MEA), diethanolamine (DEA), triethanolamine (TEA), diglycolamine (DGA), monoisopropanolamine (MIPA), diisopropanolamine (DIPA), triisopropanolamine (TIPA), methyldiethanol amine (MDEA), 2-amino-2-ethyl-1,3-propanediol, 2-amino-2-methyl-1-propanol and mixtures thereof.

According to one embodiment, the lubricating composition comprises at least one corrosion inhibitor, preferably at least one organic corrosion inhibitor.

Organic corrosion inhibitors include aliphatic monocarboxylic acids, more particularly having from 4 to 15 carbon atoms, e.g. octanoic acid, aliphatic dicarboxylic acids having from 4 to 15 carbon atoms, e.g. decane dioic acid (sebacic acid), undecane dioic acid, dodecane dioic acid, isononanoic acid or mixtures thereof, polycarboxylic acids neutralized, if appropriate, with triethanolamine, such as the 1,3,5-triazine-2,4,6-tri-(6-aminocaproic) acid, alkanoylamidocarboxylic acids, more particularly the isononanoylamidocaproic acid, the 6-[(4-methylphenyl)sulfonyl]amino]hexanoic acid, and mixtures thereof. Borated amides, products of the reaction of amines or of amino alcohols with boric acid, can also be used.

A lubricating composition according to the invention can in particular comprise 0.01% to 15% by weight of corrosion inhibitors, preferably from 1.0% to 13% by weight relative to the total weight of the composition.

According to one embodiment, the weight ratio between the proportion of PAG and the proportion of PEA (PAG/PEA) is greater than or equal to 1, preferably greater than or equal to 2.

According to one embodiment, the lubricating composition according to the invention comprises water and:

- from 1 to 60% by weight, preferably from 5 to 50% by weight, more preferably from 10 to 40% by weight of PAG comprising alkylene oxide units having from 2 to 8 carbon atoms, preferably from 2 to 4 carbon atoms,
- from 0.5 to 30% by weight, preferably from 1 to 20% by weight, more preferably from 2 to 15% by weight, of PEA chosen from monoamines, diamines and triamines including units chosen from alkylene oxides having from 2 to 8 carbon atoms, preferably from 2 to 4 carbon atoms, with respect to the total weight of the lubricating composition.

According to one embodiment, the lubricant composition according to the invention comprises water and:

from 1 to 60% by weight, preferably from 5 to 50% by weight, more preferably from 10 to 40% by weight of PAG comprising alkylene oxide units having from 2 to 8 carbon atoms, preferably from 2 to 4 carbon atoms, from 0.5 to 30% by weight, preferably from 1 to 20% by weight, more preferably from 2 to 15% by weight, of PEA chosen from monoamines, diamines and triamines including units chosen from alkylene oxides having from 2 to 8 carbon atoms, preferably from 2 to 4 carbon atoms, from 1 to 50% by weight, preferably from 10 to 40% by weight, more preferably from 15 to 35% by weight, of amines different from a PEA, where said amine may be an alkanolamine, e.g. chosen from monoethanolamine (MEA), diethanolamine (DEA), triethanolamine (TEA), diglycolamine (DGA) 2, monoisopropanolamine (MIPA), diisopropanolamine (DIPA), triiisopropanolamine (TIPA), methyldiethanol amine (MDEA), 2-amino-2-ethyl-1,3-propanediol, 2-amino-2-methyl-1-propanol, and mixtures thereof, with respect to the total weight of the lubricating composition.

According to one embodiment, the lubricant composition according to the invention comprises water and:

from 1 to 60% by weight, preferably from 5 to 50% by weight, more preferably from 10 to 40% by weight of PAG selected from ethylene oxide-propylene oxide diblock copolymers and propylene oxide-ethylene oxide-propylene oxide triblock copolymers and mixtures thereof, from 0.5 to 30% by weight, preferably from 1 to 20% by weight, more preferably from 2 to 15% by weight, of PEAs chosen from the diamines comprising ethylene oxide units and/or propylene oxide units, with respect to the total weight of the lubricating composition.

According to one embodiment, the lubricant composition according to the invention comprises water and:

from 1 to 60% by weight, preferably from 5 to 50% by weight, more preferably from 10 to 40% by weight of PAG selected from ethylene oxide-propylene oxide diblock copolymers and propylene oxide-ethylene oxide-propylene oxide triblock copolymers and mixtures thereof, from 0.5 to 30% by weight, preferably from 1 to 20% by weight, more preferably from 2 to 15% by weight, of PEAs chosen from the diamines comprising ethylene oxide units and/or propylene oxide units, from 1 to 50% by weight, preferably from 10 to 40% by weight, more preferably from 15 to 35% by weight, of amines different from a PEA, where said amine may be an alkanolamine, e.g. chosen from monoethanolamine (MEA), diethanolamine (DEA), triethanolamine (TEA), diglycolamine (DGA) 2, monoisopropanolamine (MIPA), diisopropanolamine (DIPA), triiisopropanolamine (TIPA), methyldiethanol amine (MDEA), 2-amino-2-ethyl-1,3-propanediol, 2-amino-2-methyl-1-propanol, and mixtures thereof, with respect to the total weight of the lubricating composition.

According to one embodiment, the lubricant composition according to the invention comprises water and:

from 1 to 60% by weight, preferably from 5 to 50% by weight, more preferably from 10 to 40% by weight, of PAG corresponding to the formula (IIa):

$$H—(OCH_2CH_2)_{xx}(OCH_2CH(CH_3)_{yy}OH \quad \text{(IIa);}$$

wherein:

xx and yy are integers greater than or equal to 0 such that the PAG has a molecular weight ranging from 1,000 to 3,000 g/mol;

from 0.5 to 30% by weight, preferably from 1 to 20% by weight, more preferably from 2 to 15% by weight of PEA corresponding to formula (IV) or to formula (VI) as defined hereinabove wherein the integers r, s and t are such that the molecular weight of the PEA ranges from 1,000 to 3,000 g/mol;

with respect to the total weight of the lubricating composition.

According to one embodiment, the lubricant composition according to the invention comprises water and:

from 1 to 60% by weight, preferably from 5 to 50% by weight, more preferably from 10 to 40% by weight, of PAG corresponding to the formula (IIa):

$$H—(OCH_2CH(CH_3)_{yy}(OCH_2CH_2)_{xx}(OCH_2CH(CH_3))_{yy}OH \quad \text{(IVa);}$$

wherein:

xx, yy and yy' are integers ranging from 6 to 20, the sum yy+yy' ranges from 20 to 35, xx, yy and yy' are such that PAG has a molecular weight ranging from 1,000 to 3,000 g/mol and such that the weight ratio between $OCH_2CH_2$ units and $OCH_2CH(CH_3)$ units ranges from 0.2 to 0.7;

from 0.5 to 30% by weight, preferably from 1 to 20% by weight, more preferably from 2 to 15% by weight, of PEA corresponding to formula (VI) or to formula (VII) as defined hereinabove wherein the integers r, s and t are such that the molecular weight of the PEA ranges from 1,000 to 3,000 g/mol;

with respect to the total weight of the lubricating composition.

Preferably, the aqueous lubricating composition is substantially free of metal particles, more particularly free of metal particles which are not solubilized at ambient temperature.

The lubricating composition according to the invention can be prepared by simple mixing of the ingredients, according to any methods known to a person skilled in the art, in order to obtain a solution. If the composition comprises a biocide and/or an antifoaming agent, said biocide and said antifoaming agent are preferably added at the end of the preparation of the composition.

Applications

The invention further relates to the use of the lubricating composition according to the invention, as a fluid for metalworking, more particularly for the machining (including in particular turning, milling, drilling, sawing or else threading) of metals, the forming of metals, the cutting of metals, the stamping of metals or the rolling of metals, the metals being preferably chosen from steel and aluminum.

The lubricating composition may optionally be diluted before the use thereof, in particular when used for metal machining.

The lubricating composition according to the present invention is particularly well suited for machining metals, more particularly for turning, milling, drilling, sawing and/or threading.

The present invention further relates to a method for lubricating metal surfaces for the working of the surfaces, in particular aluminum or steel, comprising bringing the lubricating composition according to the invention into contact with the metal surface, in particular aluminum or steel, e.g. by depositing the lubricating composition on the metal surface.

According to one embodiment, the lubrication method according to the invention further comprises a step of machining and/or forming and/or cutting and/or stamping and/or rolling said metal (coated with the lubricating composition), the machining including in particular turning, milling, drilling, sawing, or else threading. Preferably, said additional step is a metal machining step, more particularly turning, milling, drilling, sawing and/or threading.

Indeed, the inventors observed that the combination of a PAG and a PEA made it possible to obtain a lubricating composition having excellent lubricating properties for metalworking, and more particularly for steel and aluminum.

The lubricating composition according to the invention thereby has a universality in that same can be used both for machining steel and for machining aluminum.

The lubricating composition according to the invention thereby has an excellent service life and a very high duty cycle, in particular higher than the fluids, containing mineral oil, of the prior art.

A further subject matter of the invention is the use of 0.5 to 30% by weight of polyetheramines (PEA) in a lubricating composition comprising water and 1 to 60% by weight of polyalkylene glycol (PAG), relative to the total weight of the lubricating composition, to improve the lubricating properties of a metal surface, such as an aluminum or steel surface. More particularly, the use of PEA in a solution comprising water and PAG reduces the power generated during metalworking.

The PEA or PEAs used in the aforementioned use can have one or a plurality of the features and preferences described hereinabove in the context of the lubricating composition according to the invention.

The PAG or PAGs used in the aforementioned use can have one or a plurality of the features and preferences described hereinabove in the context of the lubricating composition according to the invention.

The lubricating composition resulting from the aforementioned use can have one or a plurality of the features and preferences described hereinabove in the context of the lubricating composition according to the invention.

EXAMPLES

In the remainder of the present description, examples are given by way of illustration of the present invention and under no circumstances are intended to limit its scope.

Example 1: Tests Measuring the Drift in Machining Power Required by the Aluminum Spindle to Perform the Operation The lubricating compositions tested are given in detail in Table 1. The percentages are expressed in percentages by weight with respect to the total weight of composition.

The ingredients used are the following:

PAG=sequenced triblock copolymer comprising successively propylene oxide, ethylene oxide and propylene oxide units, having a molecular weight ranging from 1,100 to 3,000 g/mol;

PEA=polyether diamine containing only propylene oxide units and having a molecular weight ranging from 1,000 to 3,000 g/mol;

pH regulator=amine;

additives=additives conventionally used in fluids intended for metalworking, comprising in particular an anti-corrosion agent, an anti-oxidant, an emulsifier.

TABLE 1

| | CC1 | CI1 |
|---|---|---|
| PAG | 20% | 20% |
| PEA | — | 4% |
| pH regulator | 25% | 25% |
| water | 37.12% | 33.12% |
| additives | 17.88% | 17.88% |

The lubricating compositions CC1 and Cl1 are tested and compared.

The purpose of the test is to measure the torque obtained by drilling 7 consecutive holes on an aluminum material, using a Microtap test machine. The test is carried out in section. During drilling, a speed of 600 rpm is used to drill a pre-hole with a depth of 6 mm, with a screw pitch between 2 and 5 mm.

The results are expressed as a percentage gain compared to a lubricating composition marketed for machining aluminum (called reference).

The test is carried out at ambient temperature.

For the test, the lubricating compositions described in Table 1 are diluted to 10%, in water.

A drop of lubricating composition to be tested is added into each hole, the hole is 100% filled with the lubricating composition, preventing air bubbles.

The protocol is as follows:

the force torque exerted by the spindle incorporating the drill bit is measured for each hole, an average of the generated power is calculated;

the torque versus time per hole is recorded;

the temperature before/after each hole is measured; an average is calculated;

the relative torque and the temperature increase of the tested composition are calculated with respect to the reference.

The results are shown in Table 2. The result (the torque) is expressed as a percentage of the reference composition.

TABLE 2

| | CC1 | CI1 |
|---|---|---|
| gain % | −1.3% | −6.9% |

The results of Table 2 show that the lubricating composition according to the invention Cl1 generates significantly less power for the lubrication of the aluminum part. The lubricant composition according to the invention thus has better properties than the comparative composition CC1.

Example 2: Tests Measuring the Service Life on Steel

In the example, the composition Cl1 (see Table 1) is compared with a commercial composition including an oil-in-water emulsion not comprising PAG nor PEA (CC2) marketed for steel working.

For the test, the composition Cl1 described in Table 1 is diluted to 8%.

The test protocol is the following:

The machine is a semi-industrial machine tool. The steel tool is used to make 460 holes, successively, on a steel plate under the following conditions:

speed of rotation of the spindle N=6478 rpm cutting speed Vc=203 m/min.

feed speed per revolution F=0.3 mm/hole drilling depth 42 mm diameter 10 mm

The diameter of the holes is measured, as well as the power required to make the holes.

The power drift during machining is determined, as well as the diameter drift (also called metrological drift). The more significant the drift, the shorter the service life of the lubricating composition.

The results are shown in Table 3.

TABLE 3

| | CC2 | CI1 |
|---|---|---|
| Power drift | 39% | 25% |
| Diameter drift | 20 μm | 12 μm |

The results of Table 3 show that the lubricating composition according to the invention has a better service life than the commercial composition of the prior art, during the machining of steel parts.

Example 3: Tests Measuring Lubricating Properties (Coefficient of Friction)

The lubricating compositions tested are given in detail in Table 4. The percentages are expressed in percentages by weight with respect to the total weight of composition.

The ingredients used are the following:

PAG=sequenced triblock copolymer comprising successively propylene oxide, ethylene oxide and propylene oxide units, having a molecular weight ranging from 1,100 to 3,000 g/mol;

PEA=polyether diamine containing only propylene oxide units and having a molecular weight ranging from 1,000 to 3,000 g/mol;

pH regulator=amine;

additives=additives conventionally used in fluids intended for metalworking, comprising in particular an anti-corrosion agent, and an anti-oxidant.

TABLE 4

| | CC3 | CI2 |
|---|---|---|
| PAG | — | 20% |
| PEA | 20% | 4% |
| pH regulator | 25% | 25% |
| water | 37% | 41% |
| additives | 14% | 14% |

For the test, the compositions described in Table 4 are diluted to 10%, in water.

The purpose of the test is to measure the extreme-pressure properties of the compositions. The lubricating compositions CC3 and Cl2 are tested and compared, using a 4-ball test as per the standard STM D2783, adapted with the following parameters:

speed close to 1,500 rpm, ambient temperature, i.e. approximately 20° C., charging time of 1 minutes for the measurement of the welding load or 10 seconds for the measurement the last load before seizing, initial contact pressure of approximately 3.5 GPa.

The measurement of extreme pressure is carried out by rotating a stainless steel ball on three stainless steel balls which are held immobile, the 4 balls being completely covered with a lubricant film. A load is applied to the balls and gradually increased (in steps of 10 kg) until the balls are welded together. The balls are changed before each increase of the load.

The extreme pressure power corresponds to the value of the load from which the 4 balls weld to each other, preventing the rotation of the upper ball on the other 3. The greater the load, the higher the extreme pressure power.

The results are shown in Table 5. For such testing, the tests were carried out under the conditions of dilution of the lubricating composition on a machine, namely at a dilution comprised between 8 and 10%.

TABLE 5

| | CC3 | CI2 |
|---|---|---|
| Welding load (kilogramforce) | 120 | 140 |

The results of Table 5 show that the lubricating composition according to the invention Cl2 makes it possible to have better extreme-pressure properties than the comparative lubricating composition CC3.

The lubricity of the compositions CC3 and Cl2 is also evaluated and compared using a Plint SRV test.

The Plint SRV test is carried out according to the publication JSAE 9436260 (Frictional Characteristics of Organomolybdenum Compound with Addition of Sulfurized Additives Takashi Kikuchi, Yoko Yonekura, Kenyu Akiyama (Toyota Motor Corporation), pp. 105-108, 13) with the following characteristics:

travel: 2.2 mm, frequency: 30 Hz (0.13 m/s), load 150 N, temperatures (° C.): 40, 50, 60, 70.

The results are shown in Table 6. For such testing, the tests were carried out under the conditions of dilution of the lubricating composition on a machine, namely at a dilution comprised between 8 and 10%.

TABLE 6

| Coefficient of friction | CC3 | CI2 |
|---|---|---|
| 40° C. | 0.13 | 0.12 |
| 50° C. | 0.14 | 0.12 |
| 60° C. | 0.15 | 0.11 |
| 70° C. | 0.16 | 0.11 |

The results of Table 6 show that the lubricating composition according to the invention Cl2 makes it possible to have better lubricating properties than the comparative composition CC3, since the coefficients of friction are lower, more 5 particularly at high temperature.

In summary of the above examples, the lubricating composition according to the invention comprising the combination of a PAG and a PEA makes it possible to obtain excellent properties, both for the machining of aluminum and for the 10 machining of steel, with an excellent service life, a reduced generated power and very good extreme-pressure properties.

The invention claimed is:

1. A lubricating composition comprising water and:

from 1 to 60% by weight of poly(alkylene glycol), from 0.5 to 30% by weight of polyetheramine, relative to the total weight of the lubricating composition, said poly(alkylene glycol) being chosen from block copolymers comprising ethylene oxide units and propylene oxide units, said polyetheramine being chosen from diamines comprising ethylene oxide units and/or propylene oxide units, the amines of the polyetheramine being primary amines.

2. The lubricating composition according to claim 1, comprising water and:

from 5 to 50% by weight of poly(alkylene glycol), from 1 to 20% by weight of polyetheramine, relative to the total weight of the lubricating composition.

3. The lubricating composition according to claim 1, further comprising at least one additive selected from alkaline bases, alkanolamines and mixtures thereof.

4. The lubricating composition according to claim 1, wherein the poly(alkylene glycol)(s) is(are) chosen from ethylene oxide-propylene oxide diblock copolymers and propylene oxide-ethylene oxide-propylene oxide triblock copolymers and mixtures thereof.

5. The lubricating composition according to claim 1, wherein each poly(alkylene glycol) has a molecular weight ranging from 500 to 10,000 g/mol.

6. The lubricating composition according to claim 1, wherein each poly(alkylene glycol) has a viscosity at 40° C. ranging from 10 to 1,000 mm/s.

7. The lubricating composition according to claim 1, wherein each polyetheramine has a molecular weight ranging from 500 to 5,000 g/mol.

8. A method for lubricating metal surfaces for the working of the surfaces, the method comprising a step of bringing a lubricating composition according to claim 1 into contact with the metal surface.

9. The method according to claim 8, further comprising a step of machining and/or forming and/or cutting and/or stamping and/or rolling the metal.

10. A method for improving the lubricating properties during metalworking with a lubricating composition, the method comprising a step of adding from 0.5 to 30% by weight of polyetheramines in a lubricating composition comprising water and from 1 to 60% by weight of poly (alkylene glycol), relative to the total weight of the lubricating composition, said poly(alkylene glycol)(s) being selected from block copolymers comprising ethylene oxide units and propylene oxide units, said polyetheramine being chosen from diamines comprising ethylene oxide units and/or propylene oxide units, the amines of the polyetheramine being primary amines.

11. The method according to claim 10, wherein the lubricating composition has one or more of the following characteristics:

the lubricating composition comprises water and:

from 5 to 50% by weight of poly(alkylene glycol), from 1 to 20% by weight of polyetheramine;

the lubricating composition further comprises at least one additive chosen from alkaline bases, alkanolamines and mixtures thereof;

the poly(alkylene glycol)(s) is(are) chosen from ethylene oxide-propylene oxide diblock copolymers and propylene oxide-ethylene oxide-propylene oxide or ethylene oxide-propylene oxide-ethylene oxide triblock copolymers, and mixtures thereof;

each poly(alkylene glycol) has a molecular weight ranging from 500 to 10,000 g/mol;

each poly(alkylene glycol) has a viscosity at 40° C. ranging from 10 to 1,000 $mm^2/s$;

the polyetheramine(s) are chosen from diamines comprising ethylene oxide units and/or propylene oxide units;

each polyetheramine has a molecular weight ranging from 500 to 5,000 g/mol.

12. The method according to claim 10 or 11 for improving the lubricating properties of the lubricating composition during machining and/or forming and/or cutting and/or stamping and/or rolling metals.

13. The lubricating composition according to claim 1, further comprising at least one additive selected from alkaline bases, alkanolamines and mixtures thereof, the alkanolamines being chosen from monoethanolamine, diethanolamine, triethanolamine, diglycolamine, monoisopropanolamine, diisopropanolamine, triisopropanolamine, methy ldiethanol amine, 2-amino-2-ethyl-1,3-propanediol, 2-amino-2-methyl-1-propanol and mixtures thereof, the alkaline bases being chosen from potassium hydroxide and sodium hydroxide.

14. The lubricating composition according to claim 1, wherein each poly(alkylene glycol) has a molecular weight ranging from 800 to 5,000 g/mol.

15. The lubricating position according to claim 1, wherein each polyetheramine has a molecular weight ranging from from 1,000 to 3,000 g/mol.

16. The method according to claim 8, wherein the metals are chosen from steel and aluminum.

17. The method according to claim 8, wherein the lubricating composition has one or more of the following characteristics:

the lubricating composition according to the invention comprises water and:

from 5 to 50% by weight of poly(alkylene glycol), from 1 to 20% by weight of polyetheramine;

The lubricating composition further comprises at least one additive chosen from alkaline bases, alkanolamines and mixtures thereof;

the poly(alkylene glycol)(s) is(are) chosen from ethylene oxide-propylene oxide diblock copolymers and propylene oxide-ethylene oxide-propylene oxide or ethylene oxide-propylene oxide-ethylene oxide triblock copolymers, and mixtures thereof;

each poly(alkylene glycol) has a molecular weight ranging from 500 to 10,000 g/mol;

each poly(alkylene glycol) has a viscosity at 40° C. ranging from 10 to 1,000 mm/s;

the polyetheramine(s) are chosen from diamines comprising ethylene oxide units and/or propylene oxide units;

each polyetheramine has a molecular weight ranging from 500 to 5,000 g/mol.

18. The lubricating composition according to claim 1, wherein the weight ratio between the proportion of the poly(alkylene glycol)(s) and the proportion of the polyetheramine(s) is greater than or equal to 1.

* * * * *